US010822146B2

(12) United States Patent
Stuart et al.

(10) Patent No.: US 10,822,146 B2
(45) Date of Patent: Nov. 3, 2020

(54) POT COMPRISING A LID HAVING A GUIDED LATCHING FEATURE

(71) Applicant: CHANEL PARFUMS BEAUTE, Neuilly-sur-Seine (FR)

(72) Inventors: Bruno Stuart, Poses (FR); Nicolas Mathieu, Les Lilas (FR); Alain Pierron, Montain (FR); Lionel Dieziger, Lons le Saunier (FR)

(73) Assignee: CHANEL PARFUMS BEAUTE, Neuilly-sur-Seine (FR)

( * ) Notice: Subject to any disclaimer, the term of this patent is extended or adjusted under 35 U.S.C. 154(b) by 150 days.

(21) Appl. No.: 16/306,052

(22) PCT Filed: May 30, 2017

(86) PCT No.: PCT/FR2017/051345
§ 371 (c)(1),
(2) Date: Nov. 30, 2018

(87) PCT Pub. No.: WO2017/207915
PCT Pub. Date: Dec. 7, 2017

(65) Prior Publication Data

US 2020/0122900 A1 Apr. 23, 2020

(30) Foreign Application Priority Data

Jun. 3, 2016 (FR) ..... 16 55073

(51) Int. Cl.
*B65D 43/02* (2006.01)
*B65D 55/02* (2006.01)
*A45D 33/00* (2006.01)

(52) U.S. Cl.
CPC ..... *B65D 43/02* (2013.01); *A45D 33/006* (2013.01); *B65D 55/02* (2013.01)

(58) Field of Classification Search
CPC ..... B65D 43/02; B65D 55/02; B65D 53/04; B65D 55/12; A45D 33/006; A45D 40/0068; A45D 2200/051
(Continued)

(56) References Cited

U.S. PATENT DOCUMENTS 5,957,313 A * 9/1999 Bouan ..... B65D 45/32 215/215
6,793,081 B1 * 9/2004 Derman ..... B65D 55/14 215/201
(Continued)

FOREIGN PATENT DOCUMENTS

EP 2 639 181 A2 9/2013
FR 2 969 127 A1 6/2012
(Continued)

*Primary Examiner* — James N Smalley
(74) *Attorney, Agent, or Firm* — Greenblum & Bernstein, P.L.C.

(57) ABSTRACT

A pot including a base and a lid, configured to adopt a closed position and an open position, that includes at least one locking strip positioned between a cover and a latching plate of the lid and fixed with respect to the cover, configured to adopt a locked position in which it presses against a rear wall of a latching element, thus holding a claw in a notch in a neck of the base, when the lid is in the closed position, and to adopt an unlocked position, in which the at least one locking strip is moved angularly with respect to its locked position and distant from the rear wall of the at least one latching element, when the lid is in the open position.

11 Claims, 8 Drawing Sheets

(58) Field of Classification Search
USPC ..... 220/319–321; 215/280–291; 132/293
See application file for complete search history.

(56) References Cited

U.S. PATENT DOCUMENTS

| | | | | |
|---|---|---|---|---|
| 9,061,804 | B2 | 6/2015 | Delage et al. | |
| 2004/0067091 | A1 | 8/2004 | Tsutsumi | |
| 2006/0201273 | A1* | 9/2006 | Beckley | B60H 1/3407 74/473.3 |
| 2008/0290092 | A1* | 11/2008 | de Bastos Reis Portugal | A47J 27/0813 220/321 |
| 2013/0221007 | A1 | 8/2013 | Jung et al. | |
| 2015/0210445 | A1* | 7/2015 | Melinger | B65D 39/12 215/277 |
| 2015/0282587 | A1* | 10/2015 | Earl | A45D 33/006 220/288 |
| 2017/0127797 | A1 | 5/2017 | Salciarini et al. | |
| 2017/0303661 | A1 | 10/2017 | Salciarini et al. | |
| 2018/0132592 | A1* | 5/2018 | Chung | A45D 40/22 |
| 2018/0242712 | A1 | 8/2018 | Salciarini et al. | |

FOREIGN PATENT DOCUMENTS

| | | | |
|---|---|---|---|
| FR | 3 022 749 | A1 | 1/2016 |
| FR | 3 026 725 | A1 | 4/2016 |
| FR | 15 51009 | | 8/2016 |

* cited by examiner

POT COMPRISING A LID HAVING A GUIDED LATCHING FEATURE

BACKGROUND

1. Field of the Invention

The invention relates to the field of pots.

For example, it relates to a pot for a cosmetic, pharmaceutical or food product comprising a lid that incorporates an improved opening and closing mechanism in order to simplify access to the product.

2. Description of the Background

Conventionally, a cosmetic product pot comprises a base, generally made from glass or plastic, i.e., a container topped with a neck the diameter of which is close to the cross-sectional dimensions of the base, so as to have a wide opening. The base is closed by a lid, generally screwed onto the neck. The lid is also generally provided with a seal that works to seal the closure for satisfactory preservation of the contents.

A drawback lies in the fact that the thread present on the neck makes it necessary to have a neck that stands clear from the rest of the base over a certain height, and also a relatively high lid; in other words, the presence of the thread imposes dimensional constraints on the height of the neck and the thickness of the lid.

Moreover, in particular for a round pot that has no screw stop, a user closing the pot has difficulty determining the moment when the lid is correctly tightened on the base. Excessive tightening causes the crushing of the seal in the long term. Insufficient tightening means that the seal does not provide satisfactory sealing. In both cases, air can enter the pot or volatile products of the formula, i.e., of the product contained in the pot, can escape from the pot, so that the formula is at risk of deteriorating over time.

For a pot with a non-circular shape the base and lid of which have identical contours, the pot often has a stop that limits the angular stroke of the lid with respect to the base so that the shapes of the base and the lid always coincide. The presence of the stop thus prevents screwing beyond it, and consequently compensates for a loss of sealing in the event that the seal is crushed.

For example, document US 2004/0067091 is known, which describes a bottle, typically for nail varnish, that enables closing by clipping the cap onto the container and opening by pressing on at least one button acting on an elastic ring. A spring device also makes it possible to ensure the sealed closing of the bottle to avoid any spillage of the product that it contains. Such a cap has the drawback, however, of having a particularly large space requirement, and in particular of resulting in a relatively significant height to accommodate the device. In addition, such an embodiment is suitable for a bottle the neck of which has a small diameter, but could be difficult to apply to a pot the neck of which has a significantly larger diameter.

For example, document EP 2639181 is known, which describes a safety cap for a container that comprises an inner cap and an outer cap configured so that, when the outer cap is turned in a closing direction, a protuberance on the outer cap is brought into contact with a protuberance on the inner cap, so that the outer cap and the inner cap turn together, thus facilitating the closing of the cap. In addition, to open the cap, pressure must be exerted between the outer cap and the inner cap in order to couple them together. Such a type of cap requires a significant height and is not very suitable for daily use.

These solutions therefore have the drawback of having a particularly large space requirement, resulting in particular in a relatively significant height of the lid to accommodate the opening and closing device.

The space requirement becomes increasingly incompatible with users' portability requirements and daily use.

To at least partially overcome the aforementioned drawbacks, French application no. 1551009 proposes a pot with an easy-to-use lid for closing and opening the pot, which makes it possible to ensure reliable closing and also results in further advantages.

SUMMARY

One of the objectives of the invention is to propose a pot the lid of which is further improved, also resulting in further advantages.

To this end, a pot is proposed, in particular for cosmetic, pharmaceutical, or food products, that comprises a base and a lid to close the base, with

- the base comprising a container topped with a neck provided with a notch, and
- the lid being configured to adopt a closed position and an open position, the lid comprising:
  - a latching plate and a cover, the latching plate and the cover being mounted rotatably with respect to each other, the lid adopting the open position when the cover is turned with respect to the latching plate with respect to the closed position,
  - at least one latching element provided with a claw, the latching element being configured to adopt a first position with the claw engaged in the notch when the lid is in the closed position and the pot is closed, and to adopt a second position, in which the claw is moved away from the neck with respect to the first position and is disengaged from the notch, when the lid is in the open position, and
  - a radial, eccentric double-acting slider and a guide stud configured to slide with respect to the slider, in particular in the slider, between a first position and a second position, the latching element adopting the first position when the guide stud is in the first position with respect to the slider and the latching element adopting the second position when the guide stud is in the second position with respect to the slider.

Here, the slider is a double opening and closing ramp. It traces a path forming a guide for the movement of the guide stud. In other terms, the slider forms an oblong keyhole. In other terms again, it forms a double cam, i.e., both an internal profile cam and an external profile cam nested in the internal profile cam, and for example of the same shape or homothetic shapes.

Thus, one edge of the slider is active for opening, and the other for closing. In other words, one of the edges acts on the guide stud to move the claw away, i.e., to enable movement to the open position, while another of the edges acts on the guide stud to move the claw closer, i.e., to return to the closed position.

The slider comprises for example a first end and a second end.

According to an embodiment, one of the first end or the second end is further away from a center of rotation of the lid than the other of the first end or the second end.

The slider is for example bean-shaped.

Such a pot makes it possible to latch and seal the lid on the base with reduced torque. There is also less friction than with conventional latching on threads.

In addition, such a pot makes it possible to perform the same opening and closing movement as with a conventional pot the lid of which is screwed to the base, for example with rotation in an anti-clockwise direction to open the pot and a clockwise direction to close it. In this configuration, the lid for example adopts the open position when the cover is turned with respect to the latching plate with respect to the closed position in an anti-clockwise direction. Conversely, the lid for example adopts the closed position when the cover is turned with respect to the latching plate with respect to the open position in a clockwise direction.

With such a pot, it is the user who decided to place the lid in the closed position or the open position according to the user's requirements.

According to an embodiment, the latching plate comprises a support, the at least one latching element being mounted on the support and mobile relative thereto.

According to an embodiment, the latching element comprises a pad, for example from which extends a hook formed by a rear wall and by the claw, which extends from the rear wall.

For example, the latching element is mounted pivotably on the support of the latching plate by the pad, i.e., via the pad.

According to an embodiment, the pad is positioned parallel to an upper surface of the support of the latching plate and is configured to pivot about an axis parallel to the pivot axis about which the cover is configured to pivot with respect to the latching plate.

According to an embodiment, the latching element comprises the guide stud and the cover comprises the slider.

According to another embodiment, the latching element comprises the slider and the cover comprises the guide stud.

According to a beneficial aspect, the lid of the pot comprises at least one locking strip, positioned between the cover and the latching plate and fixed with respect to the cover; the at least one locking strip is configured to adopt a locked position in which it is pressing against a rear wall of the at least one latching element, thus holding the claw in the notch, when the lid is in the closed position, and to adopt an unlocked position in which the at least one locking strip is moved angularly with respect to its locked position and distant from the rear wall of the at least one latching element, when the lid is in the open position.

By means of a locking strip that holds the claw of the corresponding latching element in the corresponding notch, securing the lid on the base in the closed position is better ensured.

There is at least one locking strip regardless of the number of latching elements. Preferably, there are two diametrically opposite locking strips, or even one locking strip per latching element.

In a beneficial embodiment, a locking strip is a vertical rib.

Here, a "vertical" direction denotes a direction parallel to a pivot axis about which the cover is configured to pivot with respect to the latching plate.

In a particularly convenient embodiment, the locking strip is incorporated into the cover, in particular into a contour wall of the cover.

According to a beneficial embodiment, the rear wall of the at least one latching element comprises a ramp, the ramp having a start of travel, having a first thickness, and an end of travel, having a second thickness, the start of travel being positioned angularly between the end of travel and the at least one locking strip in its unlocked position, and the first thickness being less than the second thickness.

Such a ramp makes it possible to facilitate the positioning of the locking strip against the rear wall of the corresponding latching element without a sensation of catching or resistance when a user rotates the lid from the open position to the closed position.

Optionally, the rear wall of a latching element can also comprise a groove, parallel to the locking strip, configured to receive the locking strip when it is in the locked position, further stabilising the position thereof.

According to another beneficial aspect, the cover comprises at least one protuberance, having a summit as well as a ramp and a stop face on either side of the summit along a perimeter portion of the cover, and in that the latching plate comprises at least one elastic leaf that comprises a boss, the boss having a summit as well as a ramp and a stop face on either side of the summit; the summit of the at least one protuberance being angularly distant from the summit of the boss when the lid is in the open position and the stop face of the protuberance presses against the stop face of the boss when the lid is in the closed position, the summit of the protuberance moving beyond the summit of the boss when the lid moves from the open position to the closed position, thus forming a hard spot zone.

Such a hard spot advantageously makes it possible to indicate to the user the level of screwing or unscrewing of the lid on the base of the pot.

In the open position, the boss is then angularly positioned between the claw of the latching element and the protuberance, while in the closed position, the protuberance is angularly positioned between the claw of the latching element and the boss, being held against the boss.

According to a beneficial aspect of the invention, features of the pot include the following:

- the neck comprises a recess forming an angular stop at least when the lid moves from the closed position to the open position,
- the latching plate comprises an elastically deformable indexing tab, the indexing tab extending over a perimeter portion of the latching plate, having one end embedded in a support of the latching plate and one end, opposite the embedded end, that is free, and the indexing tab comprising an outer face and an inner face, opposite the outer face, with the outer face comprising a rib extending along a perimeter portion of the latching plate and the free end being provided, on the inner face, with a spur, and
- the cover comprises at least one pair of accompanying ribs, parallel to each other, arranged at an angular distance "d" from each other.

In the closed position of the lid, one of the accompanying ribs of the pair presses on the rib of the indexing tab of the latching plate, holding the spur of the indexing tab anchored in the recess in the neck. In the open position of the lid, the two accompanying ribs of the pair are angularly distant from the rib of the indexing tab. When the lid moves from the closed position to the open position, at least one of the accompanying ribs of the pair slides on the rib of the indexing tab.

In other words, while the lid is not in the open position, at least one of the accompanying ribs presses on the rib of the indexing tab, which holds the spur in the recess in the neck of the base, thus preventing any unintended rotation of the plate with respect to the base.

Thus, while the claw of the at least one latching element is not disengaged from the notch, the orientation of the plate is maintained with respect to the base.

The indexing tab extending over a perimeter portion of the latching plate means that the embedded end is angularly distant from the free end of the indexing tab.

Furthermore, the rib of the indexing tab, which also extends in an angular direction, preferably extends over a length at least equal to the distance "d" separating the two accompanying ribs of the pair.

For example, the neck comprises a rim, underneath which the notch is formed, and the recess is formed in the rim of the neck.

The recess is for example a cut-out in the rim such that the rim then has a locally reduced thickness.

The neck comprises, again for example, at least two diametrically opposite notches and the latching plate comprises at least two indexing tabs each comprising a spur engaging with one of the notches in the closed position of the lid.

According to a beneficial aspect, the lid comprises a latching member that comprises a central frame, the at least one latching element, connected to the central frame, and at least one leaf spring; the leaf spring is on the one hand connected to the central frame and on the other hand pressing against the at least one latching element, and is configured to push back the latching element.

For example, the at least one leaf spring forms a return spring favoring the return of the latching element to the second position in order to facilitate the opening of the pot.

In addition, such a latching member makes it possible to simultaneously produce the at least one latching element and the leaf spring, or at least all of the latching elements if there are at least two of them, optionally with at least one leaf spring. The production of the at least one latching element, or of the at least one corresponding leaf spring, is therefore facilitated. Moreover, their positioning on the latching plate is then also facilitated.

In an embodiment, the leaf spring is made up of a projecting leaf, embedded in the central frame by one end and a free end of which presses against the latching element, at least when the latching element is in the first position.

When the latching element is in the second position, the leaf spring can just touch the latching element or even be distant from it.

The leaf spring, when the latching element is in the second position, is then less stressed than when the latching element is in the first position, or the leaf spring is then even at rest, i.e., unstressed.

According to another beneficial aspect of the invention, the claw of the at least one latching element comprises a sloped face configured to engage with the neck of the base to compress a seal when the lid is in the closed position and the pot is closed.

This makes it possible to help to compress the seal that is often present underneath the latching plate and presses against a lip of the neck of the base, and thus to enhance the sealing of the pot.

According to a convenient aspect of the invention, the base comprises a shoulder provided with at least one ramp and in that the latching plate comprises at least one cavity with a complementary shape configured to engage with the at least one ramp.

Such a ramp engaging with a complementary cavity in the latching plate enables easy angular indexing of the latching plate with respect to the base, and therefore of the lid with respect to the base. This not only enables the spur of the at least one indexing tab to be positioned in a corresponding recess in the neck of the base with a view to the lid moving to the closed position, but also makes it possible to ensure, for example, a given orientation of the lid with respect to the base when the pot is closed. In particular if the pot is round, it is then easy to make decoration and/or logos and/or any writing on the lid and the base coincide.

Such a ramp engaging with a complementary cavity in the latching plate makes it possible to hold the plate with respect to the base to pivot the cover with respect to the plate in a more reliable, more efficient manner.

According to a beneficial embodiment, the cover comprises, distributed every 90°, four latching elements comprising a claw, four sliders and four guide studs, each of the guide studs engaging with one of the sliders, as well as: four locking strips, and/or four leaf springs, and/or, diametrically opposite each other, at least two elastic leaves provided with a boss in the latching plate and at least two corresponding protuberances in the cover, and/or at least two pairs of accompanying ribs and two indexing tabs, each being as described in the present application.

BRIEF DESCRIPTION OF THE DRAWINGS

An embodiment of the invention will be better understood and the advantages thereof will become more apparent on reading the following detailed description, given as a non-limitative illustration, with reference to the attached drawings, in which.

DETAILED DESCRIPTION

Identical elements shown in the aforementioned figures are identified by identical numerical reference signs.

The present description is mainly given with reference to a cosmetics pot with a circular contour, but it would of course be applicable to another pot, regardless of its contour.

Conventionally, a cosmetics pot 1 has a round contour, as shown in FIGS. 1 to 14.

The pot 1 comprises a base 2 and a lid 3 used to open and close the pot 1.

The base is made from any appropriate material, in particular glass, wood, or plastic. It can be transparent or opaque.

Figure 1:
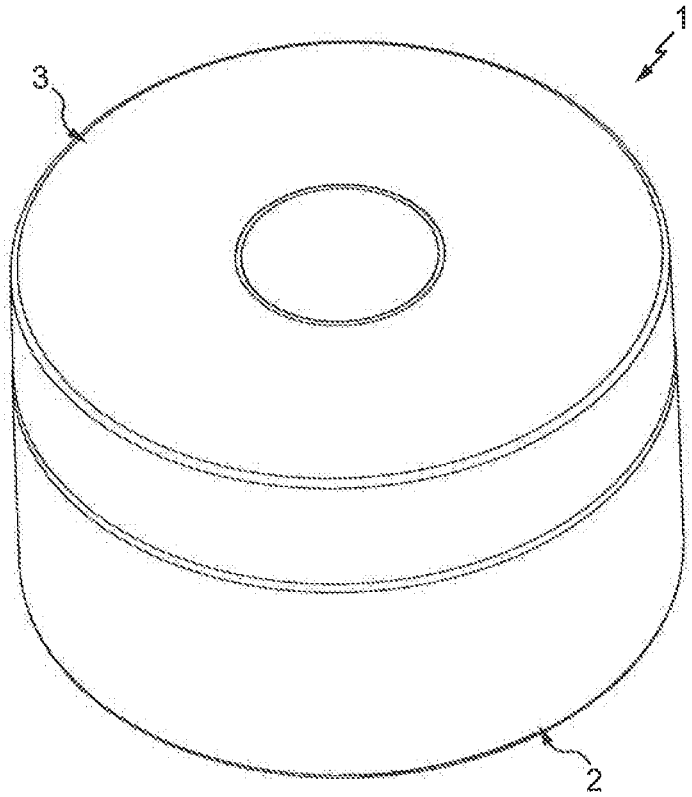
FIG. 1 shows a first embodiment of a cosmetic pot with a circular contour that comprises a base and a lid.
Figure 2:
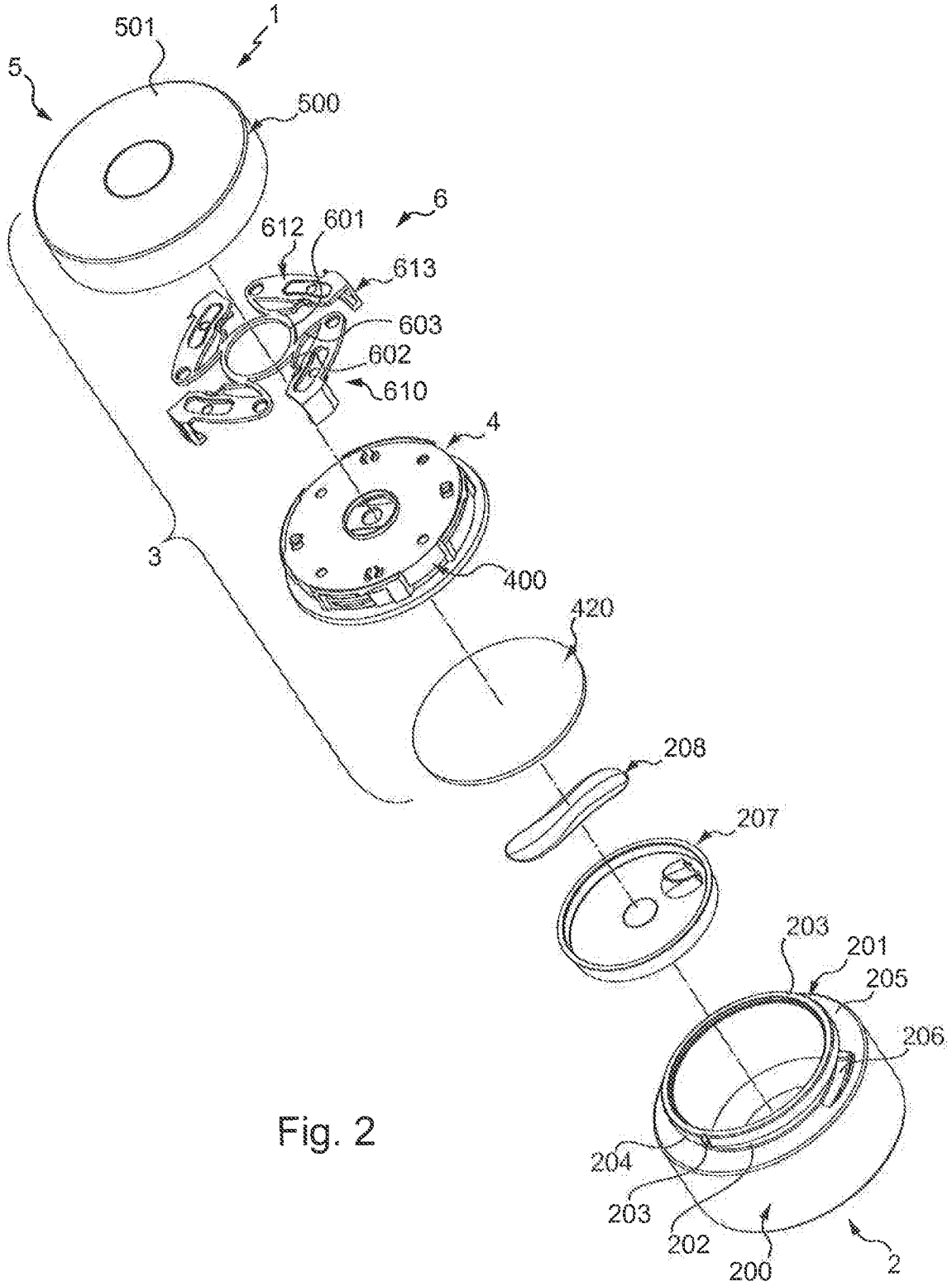
FIG. 2 shows an exploded view of the pot in FIG. 1, FIGS. 3 and 4 respectively show perspective and top views of the base of the pot in FIG. 1, according to a first embodiment of the present invention, comprising a circular neck.
Figure 3:
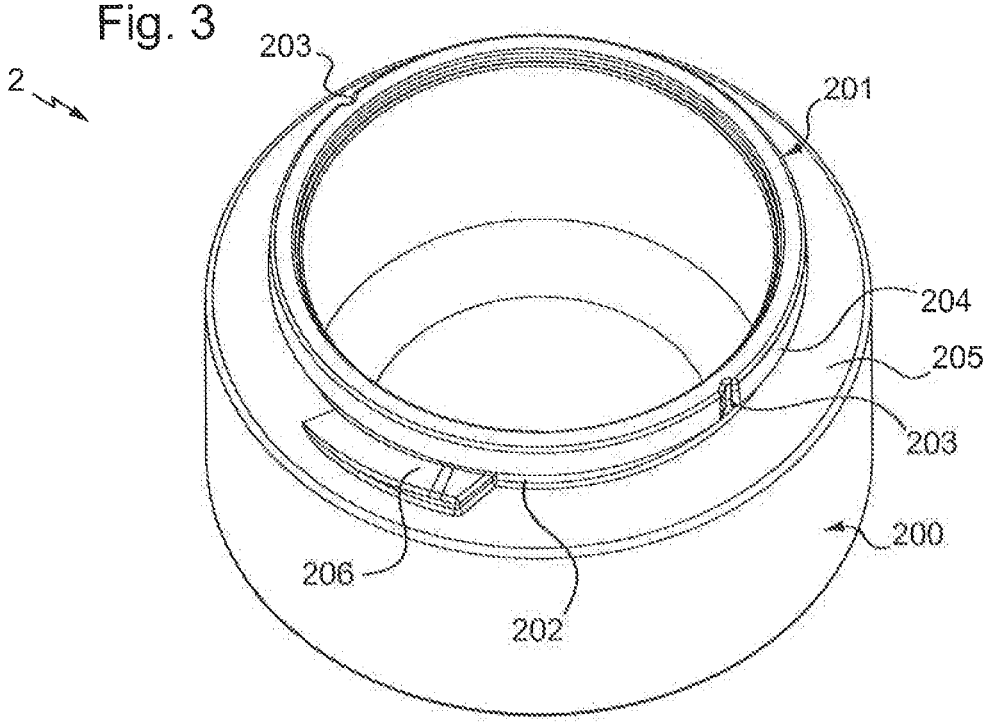
Figure 4:
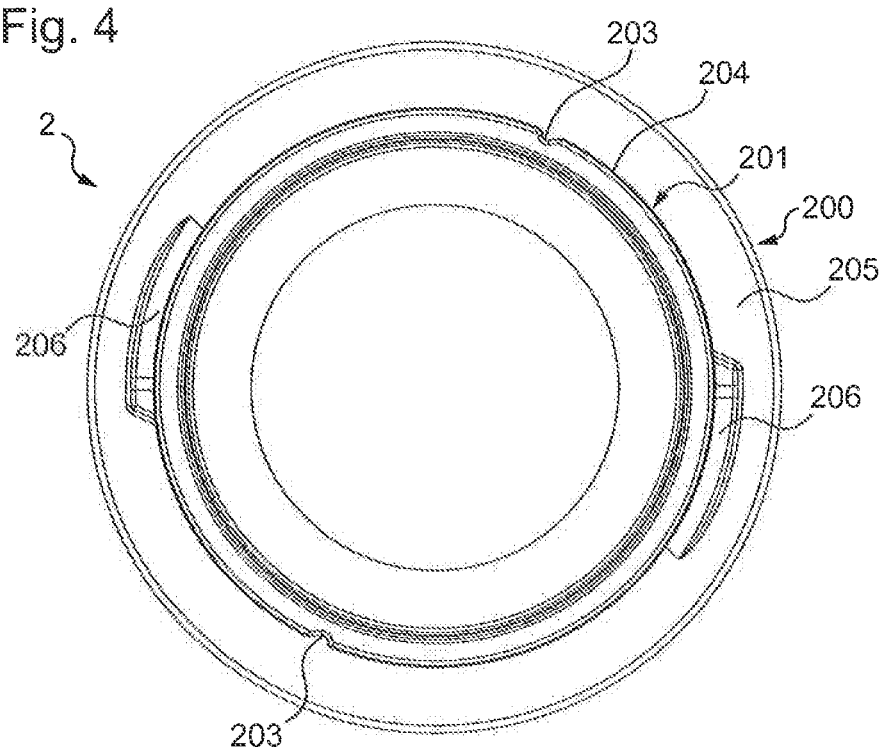

As shown in FIGS. 2 to 4, the base 2 comprises a container 200 and a neck 201 that tops the container 200.

Optionally, the base can receive an added bowl, also known as a cup, and/or be provided with a closing disc 207. The container, or the cup if applicable, contains the product, in particular the cosmetic product. This cup and/or the disc are of course optional, and the product can just as well be contained directly in the container 200.

The neck 201 defines an opening that makes it possible to access the contents (of the container 200 or the cup). The dimensions of the neck and the opening are close to the cross-sectional dimensions of the base. In any event, the opening of the pot is large enough to enable the insertion of at least one finger of a hand or a spatula, such as the spatula 208, that is, it has a cross-sectional transverse dimension greater than or equal to approximately 25 millimeters.

Here, the neck 201 comprises a notch 202 and a peripheral rim 204, underneath which the notch 202 is defined.

In particular, in this example, the neck 201 only comprises a single notch 202 that extends around the entire neck 201 continuously. In addition, here the notch 202 is formed on an outer perimeter of the neck 201.

In other words, the notch 202 is hollowed out of the neck 201 with respect to the peripheral rim 204 or, defined in the opposite way, the peripheral rim 204 is in relief on an outer perimeter of the neck 201 with respect to the notch 202.

Here, the neck also comprises at least one recess 203.

Here, the recess 203 is hollowed out of the rim 204.

In particular, the recess 203 is hollowed out over the entire height of the rim 204.

The recess 203 also has an asymmetrical cross section in a plane orthogonal to the height of the rim 204: for example, a right-hand face of the recess 203 forms an angle, with respect to a tangent to the rim 204 and a corresponding right-hand edge, that is larger than an angle formed by a left-hand face of the recess 203 with respect to a tangent to the rim 204 and a corresponding left-hand edge. Left and right are given here for reference, taking the pot in profile and looking at the recess 203 straight on.

In the present embodiment, the neck 201 comprises two diametrically opposite, identical recesses 203, as shown more particularly in FIG. 4.

The function and use of such a stop are described below.

In the present embodiment, the base comprises a shoulder 205, from which the neck 201 extends.

In particular, here the base comprises at least one ramp 206 formed in relief on the shoulder 205 and of increasing thickness, in an anti-clockwise direction, with respect to a surface of the shoulder 205. In other words, looking at the base of the pot in profile facing the ramp, the ramp is thinner on the left than on the right.

Such a ramp is configured to guide and accompany a latching plate 4 of the lid 3 into an immobilised position, with respect to a cover 5, between an open position and a closed position of the pot 1.

Widthwise, the ramp 206 is adjacent to the bottom of the notch 202 and extends radially on the shoulder 205.

Preferably, a non-zero radial distance is left between a periphery of the shoulder, corresponding to an outer envelope of the container, and the ramp 206, so that an outer face of a wall of the lid can be positioned continuing on from the outer envelope of the container to produce a continuous contour.

In the embodiment shown, the base comprises two diametrically opposite, identical ramps 206.

Here, the neck 201 is thus not provided with any screw thread or screwing ramp and, compared to a conventional neck, has a height that can be reduced. For example, by way of illustration, a pot according to the invention has a height of approximately 45 mm with a neck approximately 9 mm high and with a notch approximately 5 mm high and approximately 3 mm deep. These values are however given purely by way of illustration.

As shown in FIGS. 2 and 5 to 8 mainly, the lid 3 comprises a latching plate 4, a cover 5, mounted rotatably on the latching plate 4, and at least one latching element 610.

The cover 5 and the latching plate 4 are assembled by any appropriate means, for example a snap ring that retains the latching plate 4 inside the cover 5, or by snap-fitting the latching plate 4 into the cover 5.

The cover 5 and the latching plate 4 engage to enable easy opening and reliable closing of the pot 1 during use.

The lid 3 often also comprises a seal 420, secured underneath the latching plate 4. The seal 420 is for example compressible and flat, having a thickness of a few tenths of a millimetre, and intended to be compressed on its perimeter between the plate 4 and a lip of the neck 201 of the base 2.

The seal 420 can be made from any appropriate elastically compressible material, in particular polyethylene, SEBS, elastomer or any other equivalent material. As there is no, or very little, relative rotation of the latching plate 4 and the neck 201, the seal 420 is not, or very little, stressed in shear, and it is therefore possible to choose a relatively adherent material that has a high friction coefficient.

Instead of such a seal 420, a closing plate mounted on a suspension and coated with a reduced thickness of seal can be envisaged, as described for example in patent application FR 2969127.

In the present embodiment, the cover 5 comprises a body 500. The body 500 comprises an upper surface 501 (visible in FIG. 2 for example), a bottom 503 (visible in FIG. 5 for example), on the reverse of the upper surface 501, and a contour wall 502.

Here, the upper surface 501 forms an outer face, intended for example to be visible to a user when the pot 1 is closed. The upper surface 501 is for example customisable, and is configured to receive decoration, in the form of lacquer for example. According to one option, the upper surface is made up of several stacked, open-work additional layers in order to form the decoration, or by an additional layer of inlaid work for example. It can be made from plastic, wood, glass or other material. The upper surface 501 is for example flat or curved.

The contour wall 502 extends from the side of the bottom 503, preferably approximately orthogonally thereto.

The contour wall 502 comprises an outer contour surface **500*a* that is advantageously the same shape as the outer contour of the base 2, and an inner contour surface 503*a*. In addition, the outer contour surface 500*a* is positioned on the periphery of the upper surface 501; it is tangent to an edge of the upper surface 501. The inner contour surface 503*a* is optionally at least partially circular, i.e., it forms, at least partially, a cylinder, with a diameter at least approximately equal to the diameter of a support 400 of the latching plate 4, so that the cover 5 can pivot with respect to the latching plate 4**.

The cover 5 comprises a central stud 504 that is configured to form a pivot with the latching plate 4.

In the present embodiment, the cover 5 comprises a guide stud 508, and here even four identical guide studs 508, as there are four latching elements 610 and therefore four sliders, as described below. The guide studs 508 are positioned on the bottom 503, at equal distances from each other, i.e., approximately every 90° and the same distance from a center of rotation of the cover 5 with respect to the plate 4.

Here, each guide stud 508 is a cylinder with a circular cross section protruding from the bottom 503.

In addition, here each guide stud is incorporated into the cover.

The lid 3 also comprises at least one locking strip 505, positioned between the cover 5 and the latching plate 4, and fixed with respect to the cover 5.

Here, the locking strip 505 is incorporated into the contour wall 502, protruding from the inner contour surface 503*a*. It has a depth, from the inner contour surface 503*a*, of approximately 2 mm or 3 mm, for example. The locking strip 505 extends vertically in the cover 5 and has a thickness, i.e., the dimension around a circumference of the inner contour surface 503, that is small, for example in the order of one millimeter, for example a maximum of 1 mm.

Figure 5:
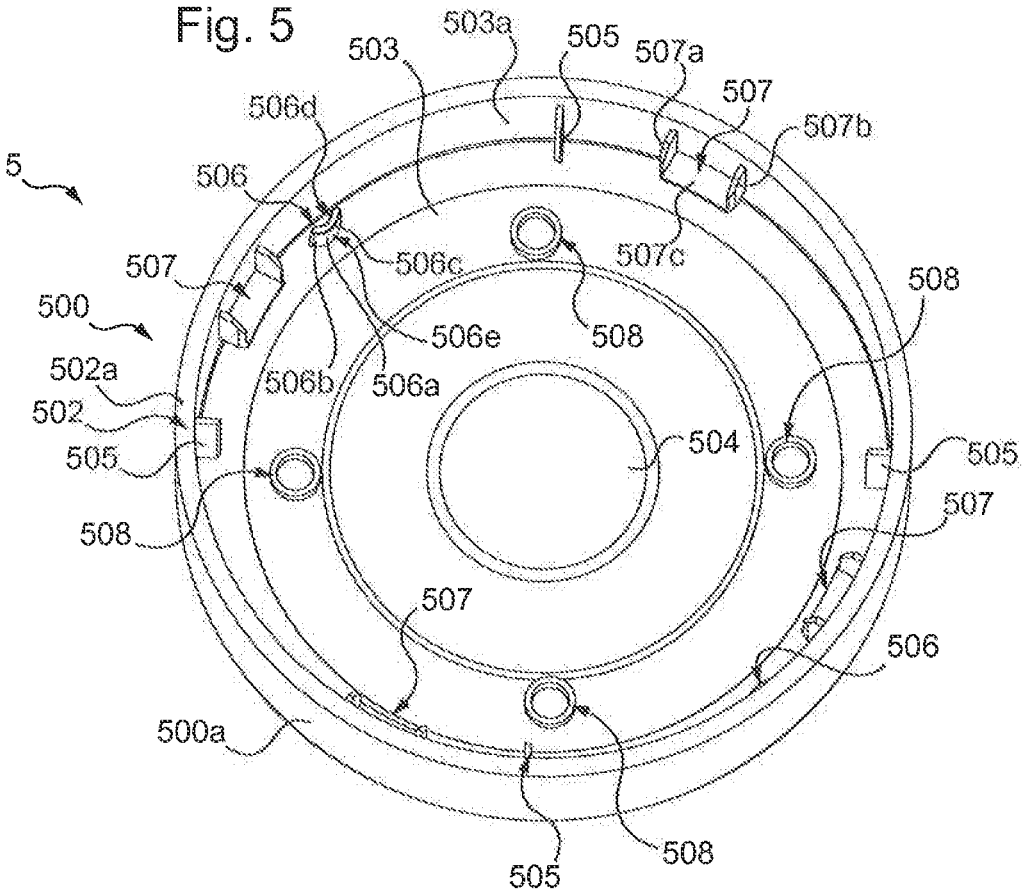
FIG. 5 shows a view of the interior, or bottom view, of a cover of the lid in FIG. 1, according to a first embodiment of the present invention.
Figure 8:
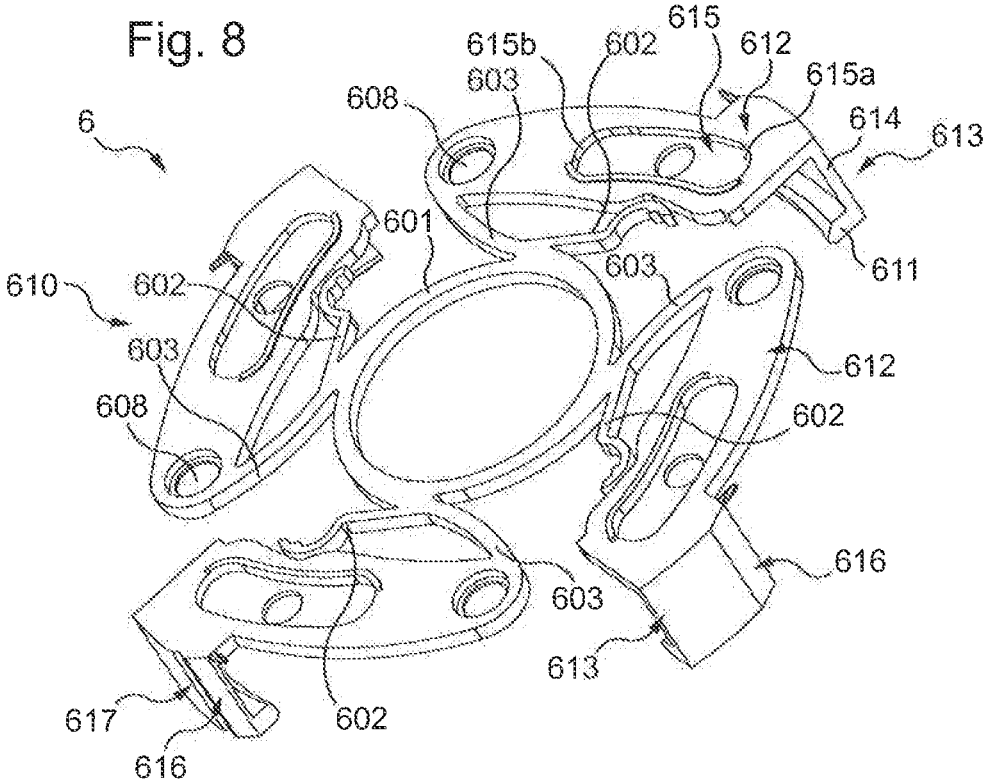
FIG. 8 shows an embodiment of a latching member according to a first embodiment of the invention.

In addition, here the locking strip 505 is approximately aligned with a guide stud 508 along a radius of the cover 5, or approximately offset in a clockwise direction with respect to said guide stud, as shown in FIG. 5.

In the present embodiment, the lid comprises four identical locking strips 505, distributed every 90° around the contour wall 502.

The cover 5 also comprises at least one protuberance 506 that extends in relief from the bottom 503.

The protuberance 506 has a summit 506*a* together with a ramp 506*b* and a stop face 506*c* on either side of the summit along a perimeter portion of the cover 5 and with the ramp 506*b* placed between the stop face 506*c* and the locking strip 505.

In other words, the protuberance 506 has an approximately curved "grain of rice" or "boomerang" shape so that a concave, i.e., hollow, portion 506*d* of the protuberance 506 is facing the inner contour surface 503*a* of the body 500 of the cover 5, while a domed portion 506*e* is facing the support 400 of the latching plate 4.

In this case, the cover 5 comprises two protuberances 506 that here are identical and diametrically opposite each other on the bottom 503.

The cover 5 also comprises at least one pair 507 of accompanying ribs 507*a* and 507*b*, which are identical, parallel, and arranged at an angular distance "d" from each other.

The accompanying ribs 507*a*, 507*b* extend vertically, protruding from the inner contour surface 503*a*.

However, the accompanying ribs 507*a*, 507*b* extend over a portion of the height of the contour wall 502, i.e., they both have ends distant from both the bottom 503 and a free rim 502*a* of the contour wall 502.

In the present embodiment, the cover 5 also comprises a bridge 507*c* connecting the two accompanying ribs 507*a*, 507*b* of a pair 507 to each other.

With reference to the inside of the cover 5, as shown in FIG. 5, the pair 507 is located to the right of the locking strip 505, in other words the pair 507 is positioned after the locking strip 505 in a clockwise direction.

If a protuberance 506 is also present, then the pair 507 is located between the locking strip 505 and the protuberance 506.

In the present example, the cover 5 comprises four pairs 507 distributed every 90°, but it could only comprise two, diametrically opposite each other, or just one, or even three, the middle one of which would be angularly distant from its neighbors by 90°.

Figure 6:
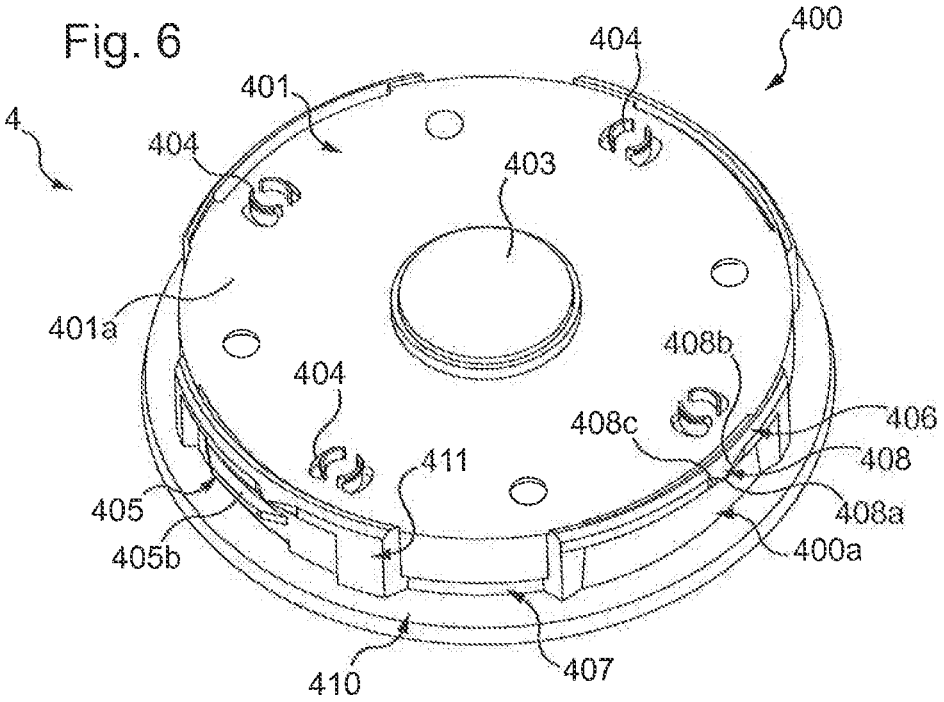
FIGS. 6 and 7 show a latching plate of the cover in FIG. 1, according to a first embodiment of the present invention, seen respectively in perspective from above and below.
Figure 7:
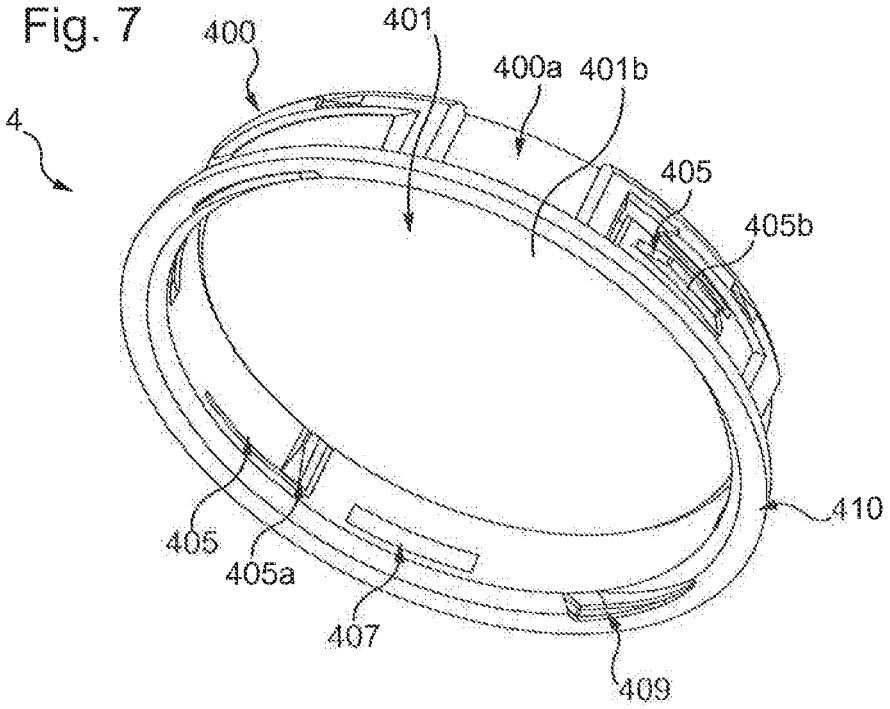

The latching plate 4, shown in particular in FIGS. 6 and 7, mainly comprises a support 400.

The support 400 is made from any appropriate material, in particular metal, for example by machining, or plastic, for example by molding.

Whatever the outer shape of the pot 1, the support 400 can have a generally cylindrical shape in order to favor rotation with the cover 5.

The support 400 comprises a contour wall 400*a* and a closing plate 401 that comprises a so-called upper surface 401*a* intended to be oriented towards the cover 5, and a so-called lower surface 401*b*, approximately parallel to the upper surface 401*a* and intended to be oriented towards the base 2.

On the side of the upper surface 401*a*, here the support 400 comprises a central stud 403 that is configured to form a pivot with the cover 5.

The central stud 403 is approximately centered with respect to the upper surface 401*a*. Here it is hollow, or in other words formed by a wall in relief with respect to the upper surface 401*a*. Here, the wall defining the central stud 403 forms a circular, closed contour.

On the side of the upper surface 401*a*, the support 400 also comprises a slug 404 forming a center of rotation about which a latching element 610 (shown in FIG. 8) pivots when it moves between a first position and a second position, as will be described below. In this case, as the pot 1 of the present embodiment comprises four latching elements 610, the support 400 therefore comprises four slugs 404.

In the present embodiment, each slug 404 is made up of two facing arcs, embodying portions of a circular cylinder, and one free upper end of which is provided with a barb, so that the corresponding latching element 610, in particular the pad 612 described below, can be clipped onto the support 400 by inserting the slug 404 into a hole 608 in said pad 612.

In the embodiment shown, the contour wall 400*a* of the plate 4 comprises one slot 407 per latching element, i.e., four slots here, arranged every 90°. Here, these slots are formed by a cut-out made in the contour wall of the plate support, distant from the closing plate 401, and make it possible to receive a claw of a hook.

Here, the plate 4 also comprises at least one indexing tab 405 and here even two indexing tabs 405 arranged diametrically opposite each other.

The indexing tab 405 is elastically deformable.

Here, the indexing tab 405 is formed by a cut-out made in the contour wall 400*a* of the support. It comprises a fastening end, by which it is embedded in the support 400, and a free end, opposite the fastening end, around a circumference of the contour wall 400*a* of the support, in other words, the indexing tab 405 extends over a perimeter portion of the support of the latching plate 4, having one end embedded in a support of the latching plate 4 and one end, opposite the embedded end, that is free. The free end and the embedded end are thus distant from each other in an angular direction. In particular, here one indexing tab 405 extends between two successive slots 407.

The indexing tab 405 comprises an outer face and an inner face, opposite the outer face.

The outer face comprises a rib 405*b* extending along a perimeter portion of the latching plate 4, between the fastening end and the free end, in other words along a length of the indexing tab. In particular, the rib 405*b* extends over a length at least equal to the length "d" separating the two accompanying ribs 507*a*, 507*b* of a pair 507. The rib 405*b* is for example approximately trapezoid.

On the inner face, the free end has a spur 405*a*. The spur 405*a* is thus configured to engage with a recess 203 in the neck 201 of the base. Any rotation of the plate 4 with respect to the base 2 is thus limited, in particular during the pivoting of the cover 5 with respect to the plate 4 to open or close the pot. If the plate 4 slides with respect to the base 2, the spur 405*a* slides along the rim 204 and then positions itself in a recess 203, preventing the pivoting of the plate 4 with respect to the base 2 and thus facilitating the pivoting of the cover 5 with respect to the plate 4. Thus, when the spur 405*a* is outside a recess 203, the indexing tab 405 is elastically deformed by bending.

In addition to a recess 203 in the base, an indexing tab 405 is thus configured to engage with a pair 507 of accompanying ribs 507*a*, 507*b* of the cover, as described below.

The latching plate 4 also comprises at least one deformable elastic leaf 406. Here, it comprises four elastic leaves 406, arranged every 90°, but it could only comprise two, for example.

In the present embodiment, the elastic leaf 406 extends, around a circumference of the support, between two successive slots 407 and is formed above an indexing tab 405 if applicable.

The elastic leaf 406 is made by an opening, directly in the support 400 of the plate, in particular between a portion of the contour wall 400*a* and the closing plate 401. This makes it possible in particular to ensure the slight deformability of a portion of the contour wall of the plate when it is in contact with a protuberance 506 during the closing or opening of the pot.

To this end, the elastic leaf 406 comprises, on an outer face, at least one boss 408. Here, the boss 408 is approximately triangular.

The boss 408 has a summit 408*a* together with a ramp 408*b* and a stop face 408*c* on either side of the summit 408*a* around a perimeter of the support 400; the summit 408*a* protrudes radially.

In an embodiment such as the one shown, the support comprises a rectangular arch-shaped section 411, also known as "inverted U-shaped". Such a section 411 comprises two vertical posts and a cross member connecting the two vertical posts to each other. The cross member then forms the aforementioned elastic leaf 406.

Figure 11:
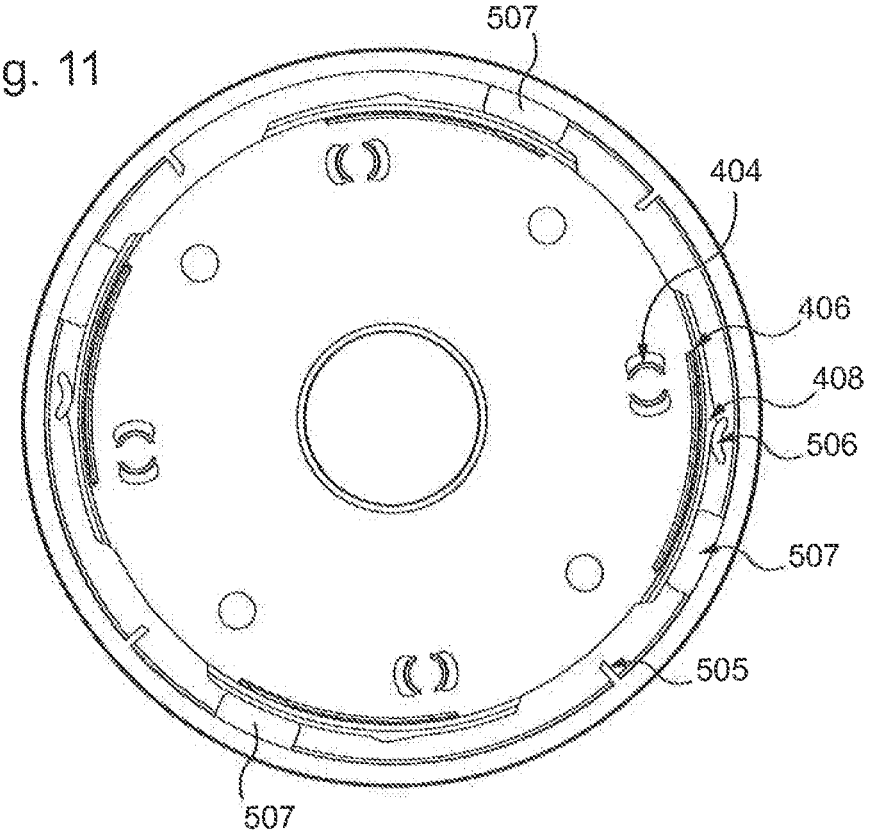
FIGS. 11 and 12 show a cross-sectional top view of the cover in FIG. 5 assembled on the plate in FIGS. 6 and 7, in the closed position and the open position respectively.

Moving across the support 400 in a clockwise direction when viewed from above as in FIG. 6, for each latching element 610, the support 400 therefore comprises a slug 404, optionally a boss 408, then a slot 407. More precisely, the stop face 408*c* of the boss 408 is positioned between the ramp 408*b* of the boss and the slot 407 (as shown in FIG. 11).

An elastic leaf 406 is thus configured to engage with a protuberance 506 on the cover.

In addition, the support comprises an inner cavity 409 configured to engage with the ramp 206 located on the shoulder 205 of the base 2. In the present embodiment, it has two inner cavities 409 configured to engage with each of the two ramps 206.

Here, each inner cavity 409 is hollowed out of a thickness of the contour wall 400*a* which, to this end, can comprise a widening, for example a flange 410. The contour wall 400*a* then extends mainly between the flange 410 and the plate 401.

To grip the lid 3 to the base 2, the lid 3 comprises at least one latching element 610.

In particular here, the lid comprises a latching member 6 (shown individually in FIG. 8) that comprises the at least one latching element 610, and in the present embodiment, four identical latching elements 610, arranged at equal distances from each other, i.e., every 90°.

Here, each latching element 610 comprises a pad 612 and a hook 613.

The hook 613 comprises a rear wall 614 and a claw 611. In other words, the rear wall 614 is connected to the pad 612 by one end thereof and comprises the claw 611 at the end thereof opposite the former.

In the present embodiment, the rear wall 614 of the hook 613 extends approximately orthogonally to the pad 612 and the claw 611 is then oriented towards a center of the latching member 6.

Here, the claw 611 is formed by a rib extending approximately orthogonally with respect to the rear wall 614 of the hook 613 towards the center of the latching member 6.

In addition, here the claw 611 has a bevelled face configured to engage with a bottom of the rim 204 of the neck 201.

The claw 611 is thus configured to grip the neck 201 of the base 2 by engaging in the slot 202 under the rim 204 when the pot 1 is closed.

In addition, such a shape of the claw contributes to compressing the seal when the pot is closed, favoring improved sealing of the pot.

In addition, here the rear wall 614 of the latching element 610 comprises a ramp 616, formed on an outer side of the rear wall.

The ramp 616 is configured to engage with a locking strip 505.

By definition, the ramp 616 has a start of travel having a first thickness and an end of travel having a second thickness.

Here, the start of travel is positioned angularly between the end of travel and the locking strip 505 in its unlocked position when the lid 3 is assembled. The first thickness is then less than the second thickness. The ramp 616 is thus configured to facilitate the positioning of the locking strip 505 against the rear wall 614 in its locked position.

Here, the rear wall 614 of each latching element 610 comprises such a ramp 616.

In addition, the rear wall 614 of at least one of the latching elements can comprise a groove 617 parallel to the locking strip 505.

The groove 617 is thus configured to receive the locking strip 505 in its locked position, further improving the stability of its position.

Here, the pad 612 is generally a curved oblong shape, but it could be any type of shape.

The pad 612 comprises a hole 608 configured to engage with a slug 404 of the support 400 to form a pivoting connection between the corresponding latching element 610 and the support 400.

In the present embodiment, the pad 612 also comprises a slider 615.

Here, the slider 615 is a cut-out in the pad 612.

The slider 615 comprises a first end 615*a* and a second end 615*b*.

In this embodiment, the first end 615*a* is further away from a center of rotation of the lid 3 than the second end 615*b* when the latching element is mounted on the support of the plate. In other words, the first end 615*a* is located more on the periphery of the support 400 than the second end when the latching element is mounted on the support 400.

Here, the second end 615*b* is positioned between the hole 608 and the first end 615*a*.

In addition, the slider 615 is a curved oblong shape, i.e., a bean shape.

The slider 615 is thus configured to receive a guide stud 508: the guide stud 508 is thus configured to slide in the slider 615.

The latching member 6 is preferably made in a monobloc manner, for example from metal or by molding of a plastic material, for example a POM (polyoxymethylene) type material, thus making it possible not only to produce all of the latching elements simultaneously when there are at least two of them, but also to facilitate the subsequent positioning of the at least one latching element 610 on the latching plate 4 during the assembly of the lid 3.

To this end in particular, the latching member 6 comprises a central frame 601 that here has a hollow circular profile, thus forming a ring.

The central frame 601 is configured to be fitted around the central stud 403 of the support of the latching plate.

From the central frame 601 extend at least one arm 603 together with at least one return spring in the form of a flexible leaf, known as a leaf spring 602.

The arm 603 connects a latching element 610 to the central frame 601. In particular, the arm 603 is connected on the one hand to the central frame 601 and on the other hand to the pad 612 of the latching element 610 by an end of the pad that comprises the hole 608, i.e., near the hole 608.

Advantageously, each arm 603 is curved and/or sloped with respect to the central frame 601 so as to impart a degree of mobility to the corresponding latching element 610.

The leaf spring 602 is configured to push back the corresponding latching element 610, thus assisting with the opening of the pot 1.

The leaf spring 602 is shaped like a curved rod comprising a C-shaped portion. The leaf spring 602 comprises a root, by which it is connected to the central frame, and a free end, so that the leaf spring 602 forms a projecting leaf. In particular, the C-shaped portion comprises the free end and the back of the C is pressing against the pad 612.

Figure 9:
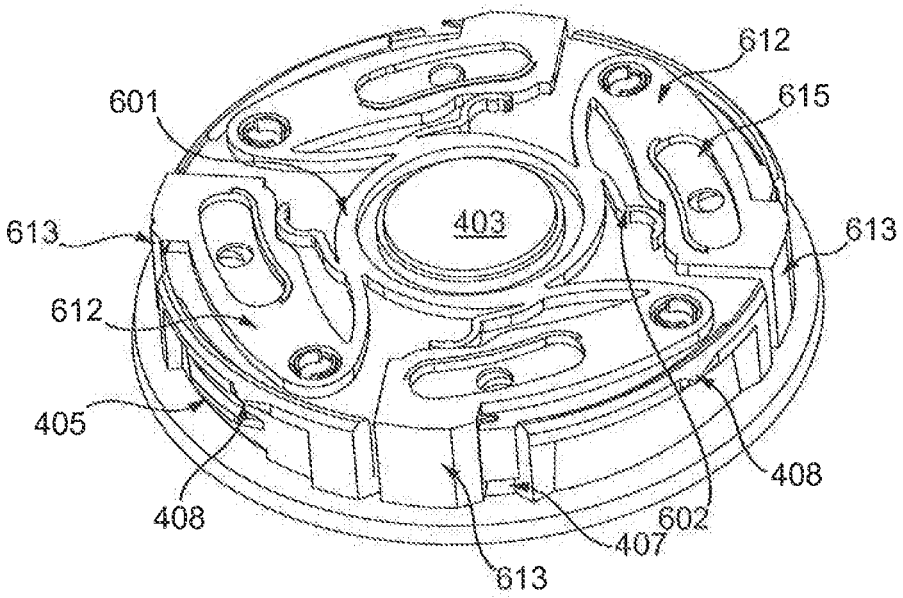
FIGS. 9 and 10 show a perspective view of the latching member in FIG. 8 on the plate in FIGS. 6 and 7, in the closed position and the open position respectively.
Figure 10:
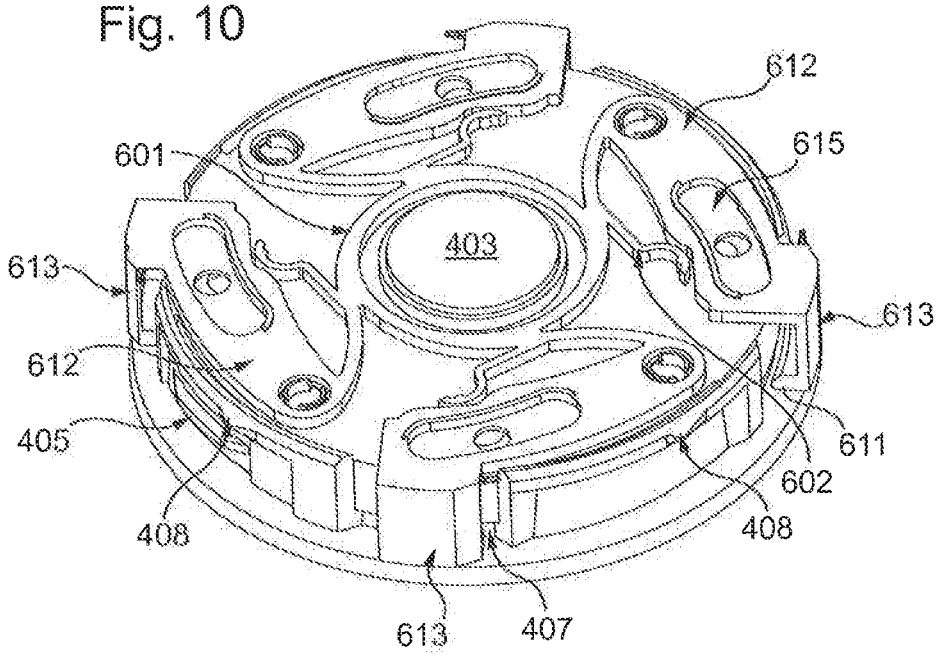

FIGS. 9 and 10 show the latching member 6 assembled on the support of the plate 4. The central frame 601 encircles the central stud 403 of the support, the holes 608 are driven onto the slugs 404 and the claws 611 of the hooks 613 are inserted into the corresponding slots 407.

Figure 12:
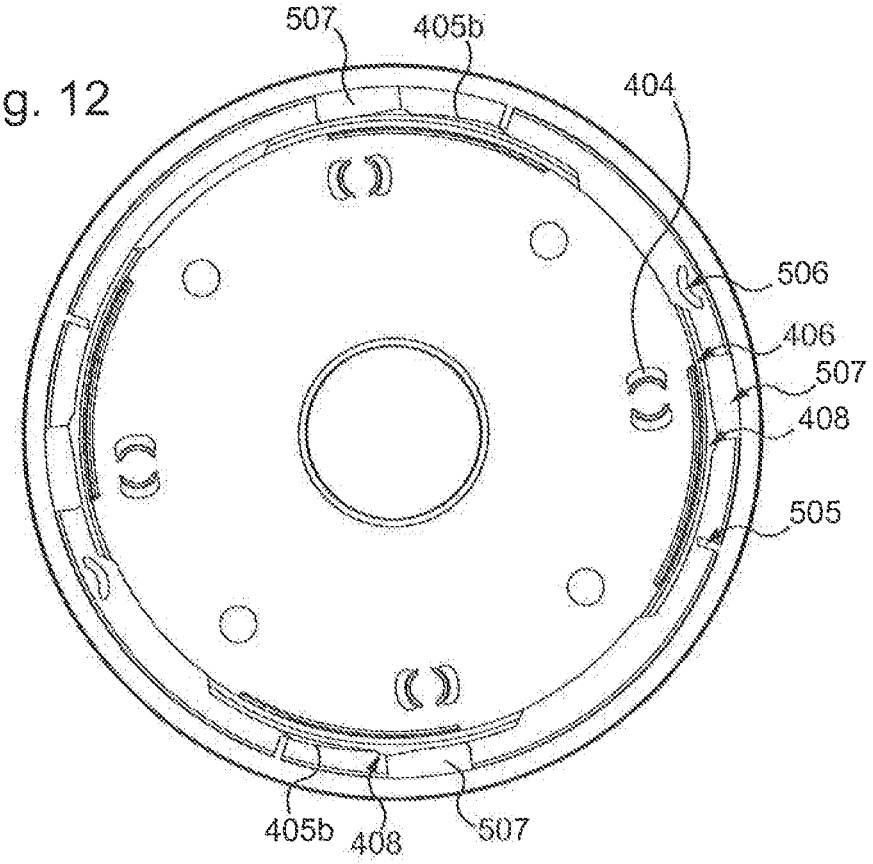
Figure 13:
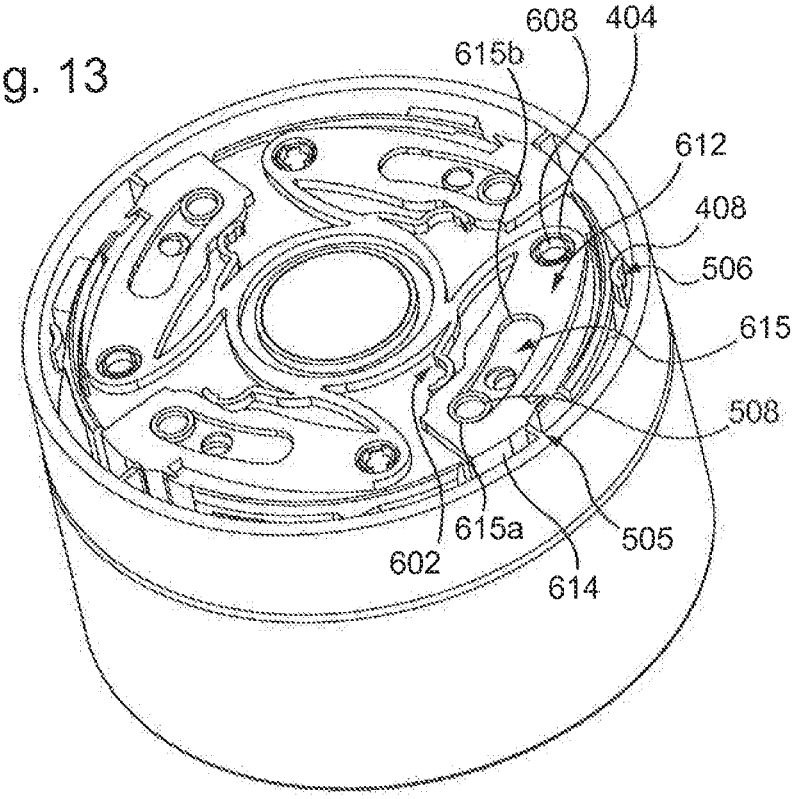
FIGS. 13 and 14 show a perspective cross-sectional view of the lid, in the closed position and the open position respectively.
Figure 14:
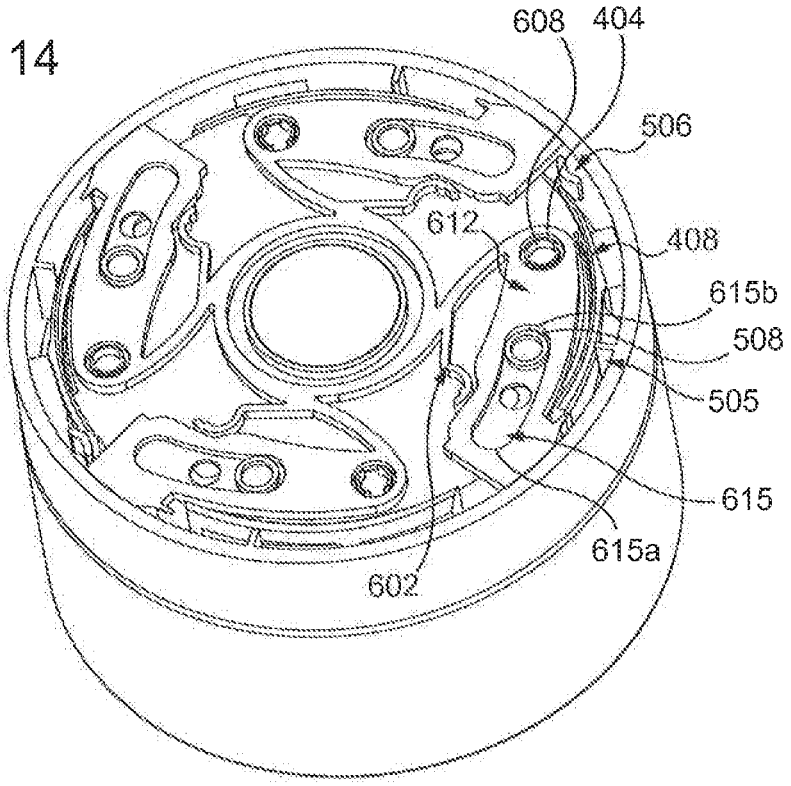

Then, once the cover 5 and the plate 4 have been assembled to each other, two operating positions of the lid are thus defined: a closed position (shown for example in FIGS. 11 and 13), and an open position (shown for example in FIGS. 12 and 14).

Each of the guide studs 508 is inserted into a slider 615 and can slide with respect to it between its first end 615*a* and its second end 615*b*.

When the lid is in the closed position, the cavities 409 in the plate 4 of the cover engage with the two ramps 206.

Each of the guide studs 508 is positioned towards the first end 615*a* of the slider 615. Each of the guide studs 508 is then distant, in the slider, from a pivoting connection between the latching element and the plate formed by a junction between the hole 608 and the corresponding slug 404. The latching elements 610 are then in the first position, i.e., a position in which the corresponding claw 611 is in a position close to the centre, so that when the lid is on the base, the claws 611 are engaged in the notch 202, under the rim 204.

In this configuration, the claws are then constrained by the locking strips 505, which press against the rear wall 614 of the latching element in order to prevent any travel thereof. The at least one locking strip 505 is thus in the locked position.

In this configuration, the at least one indexing tab 405 present on the contour wall of the plate is also constrained by at least one of the accompanying ribs of a pair 507, which presses against the corresponding rib 405*b*, and the spur 405*a* is engaged and held in the corresponding recess 203 in the neck of the base. Thus, in the closed position of the lid, at least one of the accompanying ribs of the pair of accompanying ribs of the cover presses on the rib of the indexing tab 405 of the latching plate, holding the spur 405*a* of the indexing tab 405 anchored in the recess 203 in the neck.

In addition, the stop face 506*c* of the protuberance 506 presses against the stop face 408*c* of the boss 408.

The lid of the pot is then fully closed and sealed.

When the cover is in the open position, each of the guide studs 508 is positioned towards the second end 615*b* of the slider 615. Each of the guide studs 508 is then close to the pivoting connection between the latching element and the plate formed by the junction between the hole 608 and the corresponding slug 404. The latching elements 610 are then in the second position, i.e., a position in which the corresponding claw 611 is in a position distant from the presses with respect to the first position, so that, when the lid is initially on the base, the claws 611 are disengaged from the notch 202 and can move around the rim 204, which makes it possible to separate the lid 3 from the base 2. In this position, the four leaf springs 602 can be in the resting position and just touch an edge of the corresponding pad 612.

In addition, when the lid is separated from the base, the indexing tabs 405 are in the resting position and the spurs 405*a* located at the free end thereof are disengaged from the recesses 203 in the neck.

A first portion of the rib 405*b*, located on the outer face of the indexing tab 405, is in contact with at least one accompanying rib of the pair 507. This configuration is advantageous in that it ensures permanent contact and controlled movement between the plate and the cover.

Preferably, the two accompanying ribs of the pair 507 are angularly distant from the rib 405*b* of the indexing tab 405.

In this position, at least one locking strip 505 is in the unlocked position, in which the at least one locking strip 505 is moved angularly with respect to its locked position and distant from the rear wall 614 of the at least one latching element 610.

Finally, the summit 506*a* of the at least one protuberance 506 is angularly distant from the summit 408*a* of the boss 408.

Considering for example the lid on the base, when the cover 5 is turned with respect to the plate 4 in an anti-clockwise direction from the locked position, each of the guide studs 508 travels along the corresponding slider 615 from the first end 615*a* to the second end 615*b*, which makes the latching element 610 pivot about its slug 404, in this case in an anti-clockwise direction, thus causing the pushing away of the claw 611, in particular with respect to the neck of the base 2, i.e., the claw moves from a first position to a second position. In this case, each guide stud 508 then engages with an outer edge of the slider, pushing it back to move it away from a center of the lid.

Any sliding between the plate and the base when the cover is turned with respect to the plate is prevented as the spurs 405*a* are positioned in a corresponding recess 203, which blocks all relative rotation between the plate and the base when the claws are not disengaged from the notches and when at least one of the accompanying ribs of a pair 507 slides on the rib 405*b* of an indexing tab 405.

A protuberance 506 moves over a corresponding boss 408 and the locking strip 505 moves away from the rear wall 614 of the latching element.

To close the pot, once the lid in the open position is positioned on the base, the cover 5 is turned with respect to the plate 4 in a clockwise direction; each of the guide studs 508 then travels along the corresponding slider 615 from the second end 615*b* towards the first end 615*a*, which makes the latching element 610 pivot about its slug 404, in this case in a clockwise direction, thus causing the bringing closer of the claw 611 to the neck of the base so that it engages in the notch 202 again. In this case, each guide stud 508 then engages with an inner edge of the slider, pushing it back towards a center of the lid.

The claws 611 of the latching elements 610 are thus configured so that, in the first position, the free ends of the claws are located inside an imaginary circle having as its diameter the maximum diameter of the rim 204 of the base and, in the second position, the free ends of the claws are located outside this imaginary circle.

During the rotation of the cover, the accompanying ribs come into contact with the rib of the indexing tab. This contact prestresses the indexing tabs in order to engage the corresponding spur in a recess of the neck of the container in the closed position of the pot.

At the same time, each leaf spring of the latching member is compressed by the corresponding pad and bends to a final position.

As mentioned above, the protuberances 506 of the cover come into contact, during the closing phase, with the boss 408. The ramp 506*b* of the protuberance 506 slides on the ramp 408*b* of the boss 408 until the summit 506*a* of the protuberance 506 moves over the summit 408*a* of the boss 408 and the stop face 506*c* of the protuberance 506 is immobilized in contact with the stop face 408*c* of the boss 408. This hard spot advantageously enables the user to identify the level of closure of the pot simply.

In the different embodiments described, the movement from the open position to the closed position and the reverse movement are performed with less torque than for a conventional pot with a screwed lid. The first reason is that any sliding of the seal against the neck of the base is further minimized, or even avoided. The second reason is that the mechanical stresses of opening and closing are brought towards the center of the lid. As a result, the tightening or loosening torque that the user must apply to the lid to close or open the pot is lower than for a screwed pot, in which the stresses are located towards the periphery of the lid.

The invention claimed is:

1. Pot comprising:

a base comprising a container topped with a neck provided with a notch; and a lid configured to close the base;

the lid being configured to adopt a closed position and an open position, the lid comprising:

a latching plate and a cover, the latching plate and the cover being mounted rotatably with respect to each other, the lid adopting the open position when the cover is turned with respect to the latching plate to the closed position;

at least one latching element provided with a claw;

the latching element being configured to adopt:

a first position with the claw engaged in the notch when the lid is in the closed position and the pot is closed; and a second position in which the claw has been moved away from the neck with respect to the first position and is disengaged from the notch, when the lid is in the open position; and a radial, eccentric double-acting slider and a guide stud configured to slide with respect to the slider between a first position and a second position;

the latching element being configured to adopt:

the first position when the guide stud is in the first position with respect to the slider;

the second position when the guide stud is in the second position with respect to the slider;

the lid further comprising at least one locking strip positioned between the cover and the latching plate and fixed with respect to the cover;

the at least one locking strip being configured to adopt:

a locked position in which the at least one locking strip presses against a rear wall of the at least one latching element, thereby holding the claw in the notch, when the lid is in the closed position; and an unlocked position in which the at least one locking strip has been moved angularly with respect to the locked position and distant from the rear wall of the at least one latching element when the lid is in the open position.

2. Pot according to claim 1, wherein:

the rear wall of the at least one latching element comprises a ramp, the ramp comprising:

a start of travel having a first thickness, and an end of travel having a second thickness, the first thickness being less than the second thickness;

the start of travel being positioned angularly between the end of travel and the at least one locking strip in the unlocked position.

3. Pot according to claim 1, wherein:

the cover comprises:

at least one protuberance comprising a summit and, along a perimeter portion of the cover on opposite sides of the summit, a ramp and a stop face;

the latching plate comprises:

at least one elastic leaf comprising a boss, the boss having a summit and, on opposite sides of the summit of the boss, a ramp and a stop face;

the summit of the at least one protuberance is angularly distant from the summit of the boss when the lid is in the open position; and the stop face of the protuberance is configured to press against the stop face of the boss when the lid is in the closed position;

the summit of the protuberance is configured to move beyond the summit of the boss when the lid moves from the open position to the closed position and thereby forms a hard spot zone.

4. Pot according to claim 1, wherein:

the neck comprises a recess forming an angular stop at least when the lid moves from the closed position to the open position;

the latching plate comprises at least one elastically deformable indexing tab, the indexing tab extending over a perimeter portion of the latching plate and comprising:

an embedded end embedded in a support of the latching plate;

a free end, opposite the embedded end;

an inner face and an outer face opposite the inner face;

the outer face comprising a rib extending along a perimeter portion of the latching plate and the free end being provided, on the inner face, with a spur; and the cover comprises at least one pair of accompanying ribs parallel to each other, arranged at an angular distance "d" from each other;

in the closed position of the lid, one of the accompanying ribs of the pair presses on the rib of the indexing tab of the latching plate, holding the spur of the indexing tab anchored in the recess in the neck, in the open position of the lid, the two accompanying ribs of the pair being angularly distant from the rib of the indexing tab; and at least one of the accompanying ribs of the pair is configured to slide on the rib of the indexing tab when the lid moves from the closed position to the open position.

5. Pot according to claim 1, wherein:

the lid comprises a latching member, the latching member comprising a central frame;

the at least one latching element is connected to the central frame; and at least one leaf spring connected to the central frame and the at least one leaf spring pressing against the at least one latching element and configured to push back the latching element.

6. Pot according to claim 1, wherein:

the claw of the at least one latching element comprises a sloped face configured to engage with the neck of the base to compress a seal when the lid is in the closed position and the pot is closed.

7. Pot according to claim 1, wherein:

the base comprises a shoulder provided with at least one ramp; and the latching plate comprises at least one cavity with a complementary shape configured to engage with the at least one ramp.

8. Pot according to claim 1, wherein:

the at least one latching element of the lid comprises four latching elements distributed every 90° around a perimeter of the lid;

each of the four latching elements comprises:

a claw;

a radial, eccentric double-acting slider and guide stud; and a locking strip.

9. Pot according to claim 3, wherein:

the at least one latching element of the lid comprises four latching elements distributed every 90° around a perimeter of the lid;

each of the four latching elements comprises:

a claw;

a radial, eccentric double-acting slider and guide stud;

a locking strip; and the at least one elastic leaf of the latching plate comprises diametrically opposite at least two elastic leaves, each with a respective boss; and the at least one protuberance of the cover comprises at least two protuberances corresponding to respective ones of the bosses of the at least two leaves.

10. Pot according to claim 4, wherein:

the at least one latching element of the lid comprises four latching elements distributed every 90° around a perimeter of the lid;

each of the four latching elements comprises:

a claw;

a radial, eccentric double-acting slider and guide stud;

a locking strip; and the at least one pair of accompanying ribs of the cover comprises at least two pairs of accompanying ribs; and the at least one elastically deformable indexing tab of the latching plate comprises at least two pairs of accompanying elastically deformable indexing tabs.

11. Pot according to claim 5, wherein:

the at least one latching element of the lid comprises four latching elements distributed every 90° around a perimeter of the lid;

each of the four latching elements comprises:

a claw;

a radial, eccentric double-acting slider and guide stud;

a locking strip; and the at least one leaf spring connected to the central frame of the latching member comprises four leaf springs connected to the central frame of the latching member.

* * * * *